United States Patent [19]

Fish et al.

[11] Patent Number: 4,467,495

[45] Date of Patent: Aug. 28, 1984

[54] VACUUM CLEANER NOZZLE LIFT DEVICE

[75] Inventors: Warren H. Fish, Ramsey; Robert P. Sunnarborg, Anoka, both of Minn.

[73] Assignee: Whirlpool Corporation, Benton Harbor, Mich.

[21] Appl. No.: 433,370

[22] Filed: Oct. 7, 1982

[51] Int. Cl.[3] ..... A47L 5/34

[52] U.S. Cl. ..... 15/354

[58] Field of Search ..... 15/354, 355, 356

[56] References Cited

U.S. PATENT DOCUMENTS

| | | | |
|---|---|---|---|
| 1,261,453 | 4/1918 | Spielman | 15/354 |
| 1,348,585 | 8/1920 | Rosenfield . | |
| 1,482,946 | 2/1924 | Serva et al. | 15/354 X |
| 1,482,953 | 2/1924 | Tideman . | |
| 1,733,384 | 10/1929 | Mross . | |
| 1,831,551 | 11/1931 | White | 15/354 |
| 1,850,710 | 3/1932 | Fairfax . | |
| 2,104,453 | 1/1938 | Dow . | |
| 2,712,669 | 7/1955 | Frere et al. | 15/368 |
| 2,734,217 | 2/1956 | Brace | 15/339 |
| 2,741,488 | 4/1956 | Ripple | 280/44 |
| 3,148,400 | 9/1964 | Worwag | 15/327 |
| 3,683,448 | 8/1972 | Lagerstrom et al. | 15/354 |
| 4,083,079 | 4/1978 | Vermilion | 15/354 |
| 4,167,801 | 9/1979 | Erbor et al. | 15/354 |

*Primary Examiner*—Chris K. Moore

*Attorney, Agent, or Firm*—Wood, Dalton, Phillips, Mason & Rowe

[57] ABSTRACT

A vacuum cleaner nozzle adjuster for adjustably positioning a nozzle opening relative to the surface being cleaned so as to accommodate surfaces of all textures in which an integral manually accessible thumb wheel, lifting cam and locking ratchet unitary member is provided that is rotatable by manual engagement to cause the lifting cam operating against a movable front wheel support for the housing to properly position the nozzle opening and a pawl engages the locking ratchet to hold the wheel and nozzle in adjusted position.

12 Claims, 8 Drawing Figures

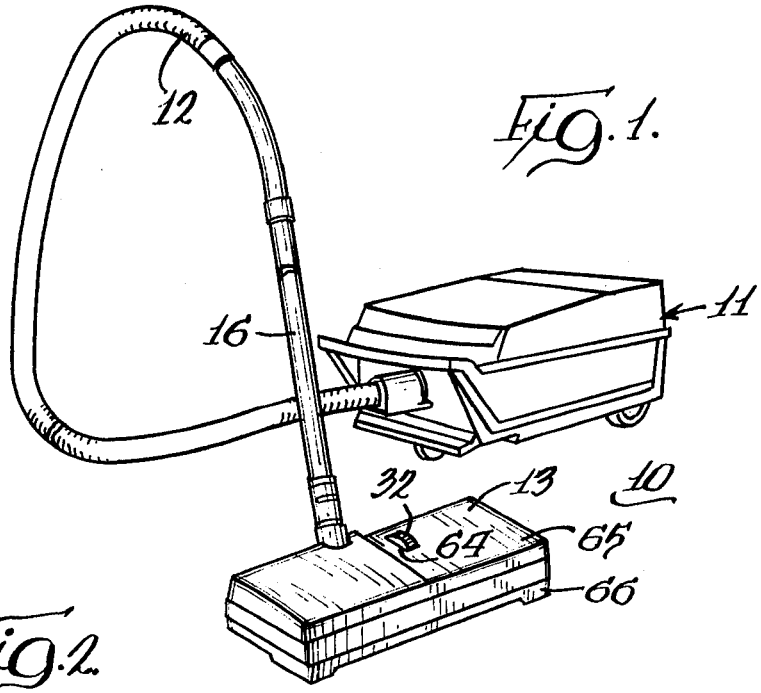
Fig. 1.
Fig. 2.
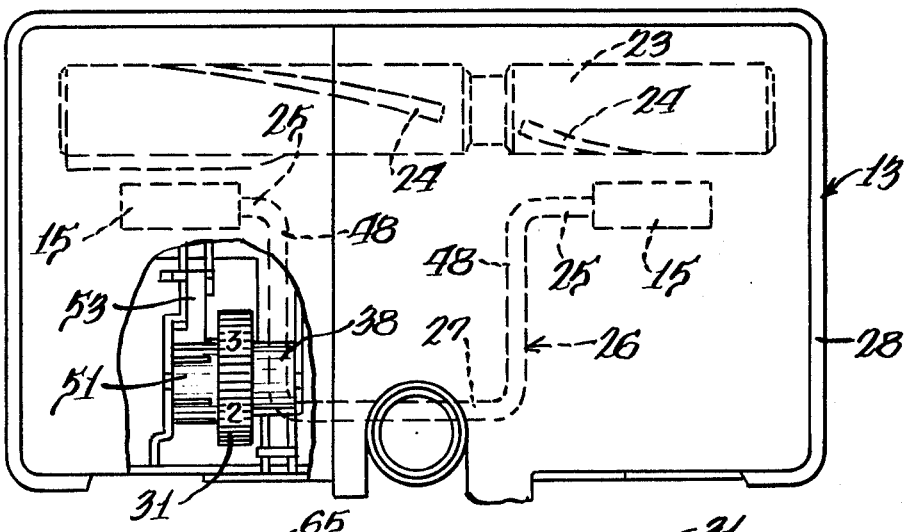
Fig. 3.
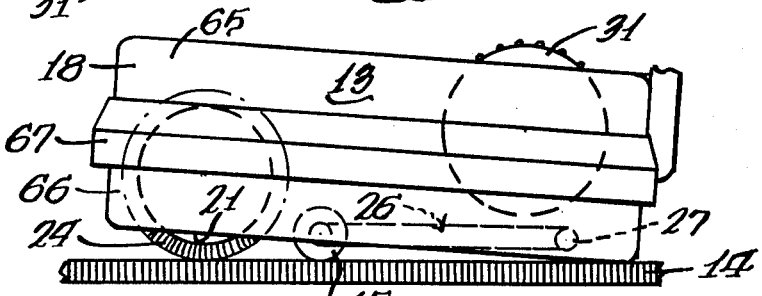
Fig. 4.
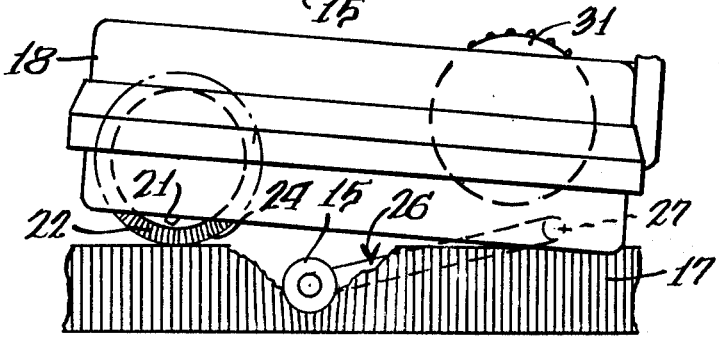

VACUUM CLEANER NOZZLE LIFT DEVICE

BACKGROUND OF THE INVENTION

1. Field of the Invention

This invention relates to a vacuum cleaner structure and in particular to means for adjustably raising the front portion of the vacuum cleaner nozzle so as to regulate the height of the nozzle opening and the rotatable cleaning brush customarily located therein relative to the surface being cleaned such as for use with different pile height carpets or for bare floors.

2. Description of the Prior Art

U.S. Pat. No. 1,850,710 discloses an adjustment mechanism for a vacuum cleaner comprising a rotatable knob fixed to a cam for vertically adjusting the nozzle height.

U.S. Pat. No. 2,104,453 discloses a vacuum cleaner having wheel height adjustment means in which supporting wheels are swung on a pivot to adjust the nozzle relative to the surface.

U.S. Pat. No. 2,712,669 discloses an adjustment knob for a vacuum cleaner nozzle height adjustment which has an index portion and a serrated edge.

U.S. Pat. No. 2,734,217 discloses a height adjuster for a vacuum cleaner nozzle using a cam with grooves and calibration markings.

U.S. Pat. No. 2,741,488 discloses a vacuum cleaner with a cam of varying radius rotated by actuation of a foot pedal to adjust the height of the nozzle relative to the surface.

U.S. Pat. No. 3,683,448 discloses a vacuum cleaner height adjusting cam which is rotated by a serrated knob to pivotally move a supporting axle.

Other U.S. patents showing various adjustable supporting mechanisms are U.S. Pat. Nos. 1,348,585; 1,482,953; 1,733,384; 3,148,400 and 4,167,801.

U.S. patent application Ser. No. 357,135, entitled "Vacuum Cleaner Nozzle Lift Device", filed Mar. 11, 1982, by David G. Koland now U.S. Pat. No. 4,437,205, issued Mar. 20, 1984, and, assigned to the same assignee as the present invention, discloses a foot pedal actuated nozzle lift mechanism including a cam follower device and a ratchet member generally similar to elements of the mechanism of the present invention.

None of the prior art patents and patent application listed above discloses an improved front wheel height adjuster for varying the height of the nozzle opening relative to the surface being cleaned and having an integral thumb wheel, lifting cam and locking ratchet unitary member together with associated parts all as claimed in the appended claims.

SUMMARY OF THE INVENTION

In the present invention, an improved vacuum cleaner nozzle adjusting means is provided which is simple, inexpensive and constructed of a minimum of parts in which the adjusting mechanism is available for manual adjustment from the exterior of the vacuum cleaner housing.

More specifically, the invention is directed to a vacuum cleaner nozzle having a housing defining an air suction passage and supported for movement over the surface being cleaned and having a rotary brush contacting the surface through a bottom nozzle opening in the housing and including an improved front wheel height adjuster. This height adjuster has a supporting wheel engaging the surface and located rearwardly of the front nozzle opening ordinarily containing the rotary cleaning brush, a hinged support in the form of a lever arm for this wheel extending rearwardly thereof and hingedly mounted on the vacuum cleaner housing for arcuate movement of the wheel relative to the housing, a unitary member comprising an integral thumb wheel for manual rotation about an axis of rotation, a lifting cam having one or more peaks of varying heights relative to said axis and a locking ratchet engaged by a spring urged pawl permitting rotation of the unitary member in only one direction so as to lock the unitary member cam and thus the nozzle height in adjusted position.

BRIEF DESCRIPTION OF THE DRAWINGS

FIG. 1 is a perspective view of a vacuum cleaner having a separate nozzle and connecting hose with the nozzle embodying the invention;

FIG. 2 is a plan view partially broken away of the top of the nozzle of FIG. 1;

FIG. 3 is a fragmentary side elevational view illustrating one position of the front of the nozzle when in lowered position;

FIG. 4 is a view similar to FIG. 3 but illustrating the front of the nozzle in raised position;

DESCRIPTION OF THE PREFERRED EMBODIMENT

Figure 5:
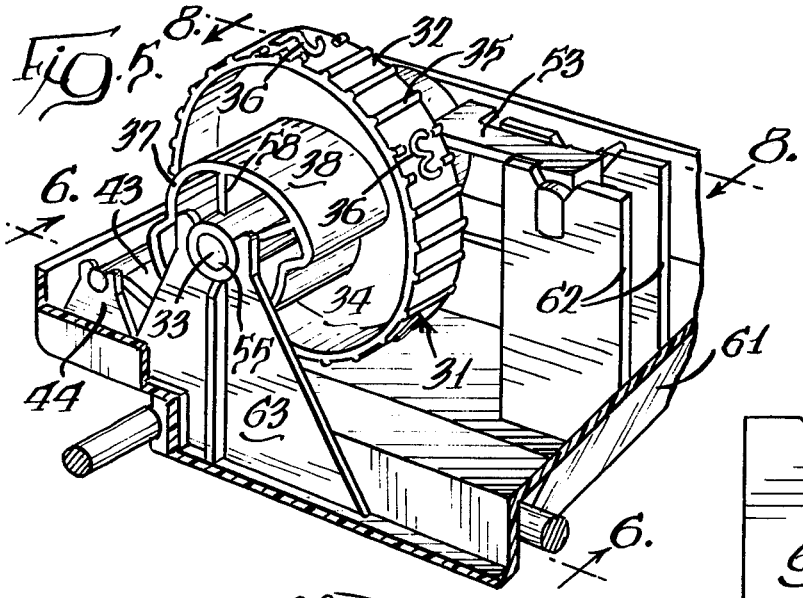
FIG. 5 is a fragmentary perspective view illustrating the unitary member embodying adjustable lifting portion of the apparatus.
Figure 8:
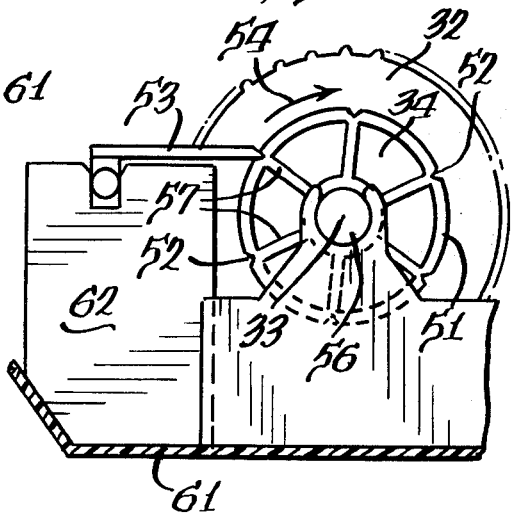
FIG. 8 is a sectional view taken substantially along line 8—8 of FIG. 5.

In the embodiment illustrated in the drawings, there is shown a vacuum cleaner 10 comprising a suction producing unit 11 which contains a motor-blower suction producing unit and a filter bag to separate dirt particles from the suction air stream, both of which are not illustrated here, a connecting suction hose 12 from the unit 11 to a suction nozzle 13 that is movable over a surface 14 on supporting wheels 15 and a manipulating wand 16 connecting the flexible hose 12 with the nozzle 13.

The surface 14 to be cleaned is illustrated at FIG. 3 as of a carpet having a short pile and therefore the supporting wheels 15 are in retracted position. A different type surface 17 illustrated in FIG. 4 is of a carpet having a long pile and the supporting wheels 15 are in raised or extended position.

The nozzle 13 has at the front end 18 thereof a nozzle opening 21 through which extends the bottom 22 of a customarily rotatable brush 23 that is rotatable by means not shown and that is provided with helically arranged brush elements 24.

As is illustrated in FIG. 2, the supporting wheels 15 which are in the form of rollers are mounted on the opposite coaxial ends 25 of a yoke 26 interconnected by a bight 27 and is spaced from and parallel to the coaxial ends 25. The yoke 26 is rotatable with the bight 27 so as to adjust the position of the supporting wheels 15 between the extreme positions of FIGS. 3 and 4 and thus the height of the nozzle 13 and brush 22 relative to the surfaces being cleaned as illustrated by the carpets 14 and 17.

The adjusting mechanism is illustrated in FIGS. 5–8 with a portion being illustrated at the broken away section of FIG. 2. In this illustrating embodiment, for positioning the supporting wheels 15 relative to the nozzle 13, the yoke 26 comprises the hinged support for the wheels that extends rearwardly thereof. This support is hingedly mounted on the housing 28 at the bight 27 of the yoke 26 for arcuate movement of the wheels 15 relative to the housing 28 comprising the nozzle 13.

The improved front wheel height adjuster as illustrated comprises a unitary adjusting member 31 that can be inexpensively molded from a synthetic resin and comprises an integral assembly of a thumb wheel 32 that is rotatable about an axis of rotation 33, the wheel having a solid internal web 34 and an outer circumference provided with spaced knurls 35 for secure manual engagement. This outer surface of the thumb wheel 32 is also provided with marked indicia 36 such as the two sets of 1, 2 and 3 illustrated for indicating the relative position of the supporting wheels 15.

Figure 6:
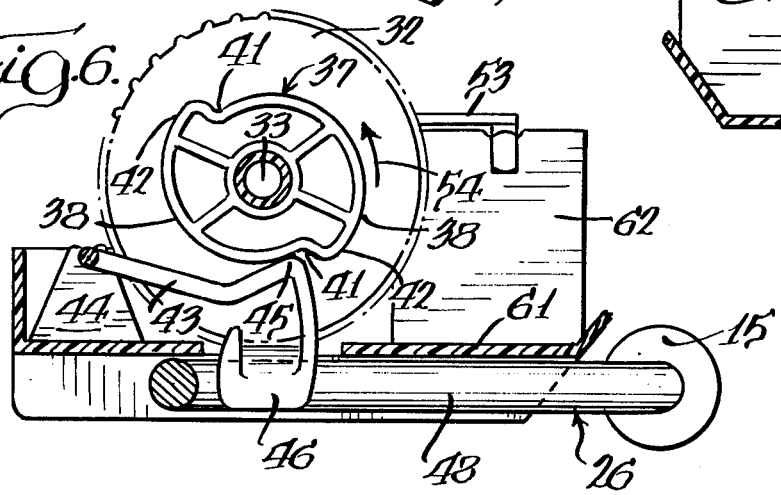
FIG. 6 is a sectional view substantially along line 6—6 of FIG. 5.
Figure 7:
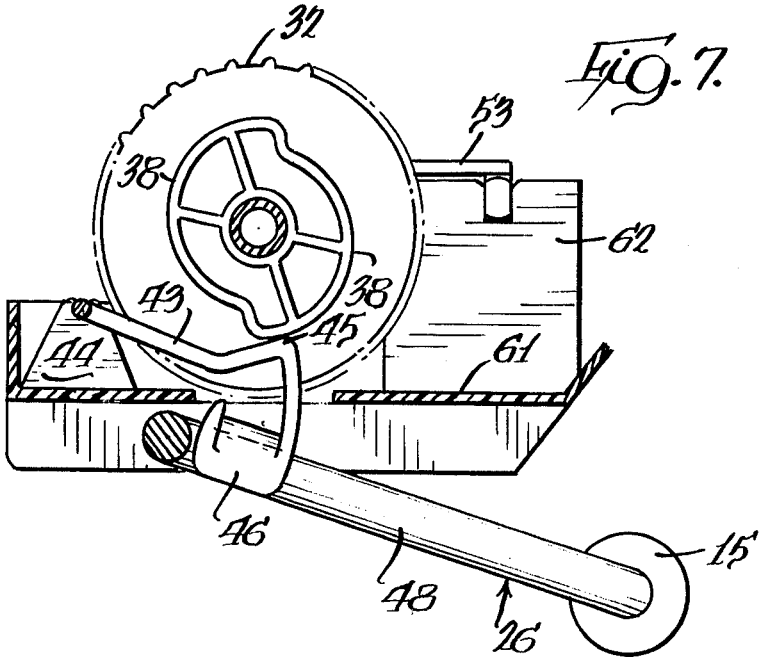
FIG. 7 is similar to FIG. 6 but showing the parts in the opposite or raised position of FIG. 6.

On one side of the web 34 there is located the cam 37 coaxial with the axis of rotation 33 and having two diametrically opposite cam surfaces 38 of gradually increasing surfaces from a low point 41 to its greatest distance from the axis of rotation 33 which thereby comprises a high point 42. As can be seen in FIG. 6 there are provided two of these cam surfaces 38 located diametrically opposite to each other and extending for about 180° each around the axis 33. With this construction, each complete revolution of the thumb wheel 32 causes two complete cycles of operation of the cam. That is, each time the cam is rotated full circle, the cam follower will be operated twice.

The cam follower illustrated at 43 is rotatably mounted on a support bracket 44 at one side of the adjusting member 31. This cam follower 43 has a cam engaging intermediate portion 45 and an end portion 46 that engages a forwardly extending intermediate leg 48 of the yoke 26 on which the supporting wheels 15 are located at the coaxial ends 25.

On the other side of the web 34 of the unitary adjusting member 31 there is located a circular locking ratchet 51 provided with spaced cross grooves 52 that are parallel to the axis of rotation 33. These grooves comprise the ratchet means that are engaged by the resilient and thereby springy pawl 53. The ratchet 51 and pawl 53 arrangement permits rotation of the thumb wheel 32 and associated parts only in a clockwise direction as indicated by the arrow 54 in FIG. 8 (this direction is, of course, counterclockwise as viewed in FIGS. 5–7).

The rotatable unit 31 is held against rotation by the ratchet 51 and pawl 53 engagement and is held against counter-rotation by the positioning of the spring pawl 53 to coincide with a chord of the circular ratchet 51. The parts of the device of this invention are most inexpensive of molded or otherwise shaped plastic materials. Thus the member 31 includes the integral wheel, cam, ratchet and aligned axle projections 55 and 56 and are of one-piece molded construction as well as the radiating strengthening webs 57 and 58. The supporting housing 61 with its supporting brackets 62, 63, 43 and 44 are also of molded plastic material. In addition, the nozzle 13 itself comprises a molded plastic and contains a top opening 64 through which the top of the thumb wheel 32 extends for manual adjustment. This nozzle 13 as is customary is provided with a top 65 and bottom 66 and an exterior resilient bumper strip 67.

Operation with the parts arranged such that the parallel legs 48 are in raised position with the supporting wheels 15 retracted as shown in FIGS. 3, 5 and 6, the front of the nozzle and the brush 24 are in position for contacting and cleaning short pile 14 carpets or even bare surfaces as illustrated in FIG. 3. When the parts are in their opposite location, the supporting wheels 15 are at their most extended position so as to maintain the nozzle opening 21 and brush 24 in proper position for cleaning deep pile carpeting, for example, as illustrated at 17 in FIG. 4.

In changing the position of the supporting wheels 15 relative to the nozzle 13, the operator manually engages the top of the thumb wheel 32 as it extends through the nozzle opening 64. The operator can only rotate the wheel 32 in one direction 54 because of the provision of ratchet 51 and pawl 53 construction. Furthermore, because of the springy nature of the pawl 53 there is a loud click when the wheel 32 has been moved to the next adjusted position.

With the parts in the position shown in FIG. 6, the wheels 15 are in their retracted position as shown in FIGS. 3 and 6. With rotation of the wheel 32 in the direction 54 (the only direction it can rotate), the cam follower 45 is pushed away from the axis 33 by the cam follower 43 bearing against the first cam surface 38 which are here shown as two, but may be one or a further plurality. They are shown as two each with its own set of numerals or indicia because this provides ratchet adjustment of position on rotation 54 of the unit and permits rapid change from the most extended position of the wheels 15 of FIG. 7 back to the most retracted position of these wheels of FIG. 6.

The foregoing disclosure of specific embodiments is illustrative of the broad inventive concepts comprehended by the invention.

We claim:

1. In a vacuum cleaner nozzle having a housing defining an air suction passage and supported for movement over a surface being cleaned and a front end having a rotary brush contacting said surface through a bottom nozzle opening in said housing, an improved front wheel height adjuster comprising:

(a) a supporting wheel engaging said surface and located rearwardly of said front nozzle opening;

(b) a hinged support lever for said wheel extending rearwardly thereof and hingedly mounted on said housing for arcuate movement of said wheel relative to said housing;

(c) an integral thumb wheel, lifting cam and locking ratchet unitary member having the lifting cam and locking ratchet on opposite sides of said thumb wheel;

(d) a cam follower engaging said cam and said support lever for moving said lever and front wheel relative to said housing for adjustably moving the position of the rotary brush relative to said surface; and (e) a spring urged pawl engaging said ratchet for holding the cam in fixed adjusted position against rotation thereof, said thumb wheel, cam and locking ratchet being coaxial with each other and with an axis of rotation, said lifting cam extending for 360° to provide a cam surface having a plurality of cams with lifting peaks symmetrically arranged around said axis for causing a corresponding plurality of cycles of operation for each 360° rotation of the cam, said unitary member being rotatable about an axis of rotation with said thumb wheel, lifting cam and locking ratchet being coaxial with said axis of rotation, whereby said wheel may be moved to variable extended positions relative to said housing as said cam follower is movably engaged by said lifting peaks.

2. The adjuster of claim 1 wherein said locking ratchet extends for 360° to provide a locking ratchet surface having spaced catch means therearound engaged by said pawl, said catch means comprising a plurality of equally spaced means arranged around the circumference of said locking ratchet.

3. The adjuster of claim 1 wherein said lifting cam and locking ratchet of said unitary member are hollow and provided with strengthening ribs on the interior of each.

4. The adjuster of claim 3 wherein said unitary member is rotatable about an axis of rotation coaxial with said thumb wheel, lifting cam and locking ratchet and said ribs are arranged substantially radially to said axis of rotation.

5. The adjuster of claim 1 wherein said unitary member is rotatable about an axis that is substantially parallel to said nozzle opening.

6. The adjuster of claim 1 wherein said thumb wheel is provided with a knurled surface extending through means providing an opening in said housing for manual manipulation of said unitary member for operation of said height adjuster.

7. The adjuster of claim 1 wherein said locking ratchet is provided with transverse grooves engaged by the narrow outer end of said pawl to hold said ratchet and thus said adjuster in fixed position.

8. In a vacuum cleaner nozzle having a housing defining an air suction passage and supported for movement over a surface being cleaned and a front end having a rotoary brush contacting said surface through a bottom nozzle opening in said housing, an improved front wheel height adjuster comprising:

(a) a supporting wheel engaging said surface and located rearwardly of said front nozzle opening;

(b) a hinged support lever for said wheel extending rearwardly thereof and hingedly mounted on said housing for arcuate movement of said wheel relative to said housing;

(c) an integral thumb wheel, lifting cam and locking ratchet unitary member having the lifting cam and locking ratchet on opposite sides of said thumb wheel;

(d) a cam follower engaging said cam and said support lever for moving said support lever and front wheel relative to said housing for adjustably moving the position of the rotary brush relative to said surface; and (e) a spring urged pawl engaging said ratchet for holding the cam in fixed adjusted position against rotation thereof, said thumb wheel, cam and locking ratchet being coaxial with each other and with an axis of rotation, said lifting cam extending for 360° to provide a cam surface having a plurality of cams with lifting peaks symmetrically arranged around said axis for causing a corresponding plurality of cycles of operation for each 360° rotation of the cam, said unitary member being rotatable about an axis of rotation with said thumb wheel, lifting cam and locking ratchet being coaxial with said axis of rotation, said lifting cam and locking ratchet of said unitary member having hollow and provided with strengthening ribs on the interior of each, said ribs being arranged substantially radially to said axis of rotation, whereby said wheel may be moved to variable extended positions relative to said housing as said cam follower is movably engaged by said lifting peaks.

9. The adjuster of claim 8 wherein said unitary member is rotatable about an axis that is substantially parallel to said nozzle opening.

10. The adjuster of claim 8 wherein said thumb wheel is provided with a knurled surface extending through means providing an opening in said housing for manual manipulation of said unitary member for operation of said height adjuster.

11. The adjuster of claim 8 wherein said locking ratchet is provided with transverse grooves engaged by the narrow outer end of said pawl to hold said ratchet and thus said adjuster in fixed position.

12. The adjuster of claim 8 wherein said locking ratchet extends for 360° to provide a locking ratchet surface having spaced catch means therearound engaged by said pawl, said catch means comprising a plurality of equally spaced means arranged around the circumference of said locking ratchet.

* * * * *

UNITED STATES PATENT AND TRADEMARK OFFICE

CERTIFICATE OF CORRECTION

PATENT NO. : 4,467,495

DATED : August 28, 1984

INVENTOR(S) : Warren H. Fish et al.

It is certified that error appears in the above-identified patent and that said Letters Patent is hereby corrected as shown below:

Column 6, line 23 (claim 8, line 35), before "hollow", cancel "having" and substitute therefor --being--.

Signed and Sealed this

*Nineteenth* Day of *August 1986*

[SEAL]

*Attest:*

DONALD J. QUIGG

*Attesting Officer*

*Commissioner of Patents and Trademarks*